US008536102B2

(12) United States Patent
Buitrago

(10) Patent No.: US 8,536,102 B2
(45) Date of Patent: Sep. 17, 2013

(54) GEAR OIL HAVING LOW COPPER CORROSION PROPERTIES

(71) Applicant: Juan A. Buitrago, Pinole, CA (US)
(72) Inventor: Juan A. Buitrago, Pinole, CA (US)
(73) Assignee: Chevron Oronite Company LLC, San Ramon, CA (US)

( * ) Notice: Subject to any disclaimer, the term of this patent is extended or adjusted under 35 U.S.C. 154(b) by 0 days.
(21) Appl. No.: 13/760,256
(22) Filed: Feb. 6, 2013
(65) Prior Publication Data
US 2013/0149191 A1 Jun. 13, 2013
Related U.S. Application Data
(60) Division of application No. 12/928,778, filed on Dec. 17, 2010, now Pat. No. 8,389,449, which is a continuation of application No. 12/187,923, filed on Aug. 7, 2008, now Pat. No. 7,871,965, which is a continuation of application No. 10/423,641, filed on Apr. 25, 2003, now abandoned.
(51) Int. Cl.
*C10M 135/22* (2006.01)
*C10M 135/36* (2006.01)
(52) U.S. Cl.
USPC ..... 508/184; 508/185; 508/189; 508/192; 508/272; 508/428; 508/569; 508/570
(58) Field of Classification Search
USPC ..... 508/184, 185, 189, 569
See application file for complete search history.

(56) References Cited

U.S. PATENT DOCUMENTS

| | | | | | |
|---|---|---|---|---|---|
| 3,197,405 | A | | 7/1965 | Le Suer | |
| 3,254,025 | A | | 5/1966 | Le Suer | |
| 3,267,033 | A | | 8/1966 | Allen | |
| 3,358,652 | A | | 12/1967 | Lawrence | |
| 3,372,735 | A | | 3/1968 | Meijer | |
| 3,533,943 | A | | 10/1970 | Papayannopoulos | |
| 3,901,932 | A | | 8/1975 | Tada et al. | |
| 3,923,669 | A | | 12/1975 | Newingham et al. | |
| 4,119,549 | A | | 10/1978 | Davis | |
| 4,119,550 | A | | 10/1978 | Davis et al. | |
| 4,136,043 | A | | 1/1979 | Davis | |
| 4,191,659 | A | | 3/1980 | Davis | |
| 4,253,977 | A | | 3/1981 | O'Halloran | |
| 4,575,431 | A | | 3/1986 | Salentine | |
| 4,600,519 | A | | 7/1986 | Gutierrez et al. | |
| 4,609,480 | A | | 9/1986 | Hata et al. | |
| 4,948,523 | A | | 8/1990 | Hutchison et al. | |
| 5,254,272 | A | | 10/1993 | Walters et al. | |
| 5,275,630 | A | | 1/1994 | Dorer | |
| 5,328,619 | A | | 7/1994 | Conary | |
| 5,342,531 | A | | 8/1994 | Walters et al. | |
| 5,354,484 | A | * | 10/1994 | Schwind et al. | 508/192 |
| 5,358,650 | A | * | 10/1994 | Srinivasan et al. | 508/194 |
| 5,358,652 | A | * | 10/1994 | Macpherson | 508/271 |
| 5,403,501 | A | | 4/1995 | Schwind | |
| 5,439,605 | A | | 8/1995 | Khorramian | |
| 5,571,445 | A | * | 11/1996 | Srinivasan et al. | 508/189 |
| 5,576,372 | A | | 11/1996 | Kresge et al. | |
| 5,622,923 | A | * | 4/1997 | Mathur et al. | 508/431 |
| 5,703,023 | A | | 12/1997 | Srinivasan | |
| 5,726,133 | A | | 3/1998 | Blahey et al. | |
| 5,801,130 | A | | 9/1998 | Francisco et al. | |
| 5,883,057 | A | | 3/1999 | Roell, Jr. et al. | |
| 5,942,470 | A | * | 8/1999 | Norman et al. | 508/189 |
| 6,096,691 | A | * | 8/2000 | Conary et al. | 508/189 |
| 6,136,759 | A | | 10/2000 | Takagi et al. | |
| 6,174,842 | B1 | | 1/2001 | Gatto et al. | |
| 6,262,000 | B1 | | 7/2001 | Reeve et al. | |
| 6,337,309 | B1 | | 1/2002 | Watts et al. | |
| 6,362,136 | B1 | * | 3/2002 | Richardson et al. | 508/186 |
| 6,413,916 | B1 | | 7/2002 | Baumgart et al. | |
| 6,528,458 | B1 | | 3/2003 | Tagliamonte et al. | |
| 6,573,223 | B1 | * | 6/2003 | Vinci | 508/192 |
| 6,617,287 | B2 | | 9/2003 | Gahagan et al. | |
| 6,689,723 | B2 | * | 2/2004 | Sullivan et al. | 508/185 |
| 6,797,679 | B2 | | 9/2004 | Kawasaki et al. | |
| 6,884,855 | B2 | | 4/2005 | Nelson et al. | |
| 7,056,871 | B2 | * | 6/2006 | Buitrago | 508/272 |
| 7,871,965 | B2 | * | 1/2011 | Buitrago | 508/184 |
| 2002/0035042 | A1 | | 3/2002 | Vinci | |
| 2002/0160922 | A1 | | 10/2002 | Milner et al. | |
| 2003/0092585 | A1 | | 5/2003 | O'Connor et al. | |
| 2003/0096713 | A1 | * | 5/2003 | Schnur et al. | 508/192 |
| 2003/0171222 | A1 | | 9/2003 | Sullivan et al. | |
| 2004/0152817 | A1 | | 8/2004 | Nelson et al. | |
| 2004/0167041 | A1 | | 8/2004 | Arimoto | |
| 2005/0070446 | A1 | | 3/2005 | Hewette et al. | |
| 2005/0124506 | A1 | | 6/2005 | Shiga et al. | |

FOREIGN PATENT DOCUMENTS

| | | | |
|---|---|---|---|
| EP | 0459656 | | 12/1991 |
| EP | 0460317 | | 12/1991 |
| EP | 0678569 | | 10/1995 |
| EP | 0531000 | | 2/1997 |
| EP | 0519760 | | 2/1999 |
| EP | 0926224 | | 6/1999 |
| EP | 0978555 | | 2/2000 |
| GB | 2265149 | A | 9/1993 |
| JP | 2000328084 | A | 11/2000 |
| JP | 2001311090 | A | 11/2001 |
| JP | 2002285184 | A | 10/2002 |
| JP | 04226196 | | 8/2004 |
| JP | 04227992 | | 8/2004 |
| JP | 05263089 | A | 9/2005 |
| WO | 9422990 | A1 | 10/1994 |
| WO | 9520592 | A1 | 8/1995 |
| WO | 9816669 | A1 | 4/1998 |
| WO | 0166677 | | 9/2001 |
| WO | 0171640 | | 9/2001 |
| WO | 0185878 | | 11/2001 |

OTHER PUBLICATIONS

ASTM Test Method "Standard Test Method for Evaluation of the Thermal and Oxidative Stability of Lubricating Oils Used for Manual Transmissions and Final Drive Axles", ASTM International (2000).
B. D. Vineyard, Mercapton-Sulfur Reaction, Alkyl Trisulfides, Journal of Organic Chemistry (1996), 31(2), pp. 601-602.
B. D. Vineyard, The Versatility and the Mechanism of the n-Butylamine-Catalyzed Reaction of Thiols with Sulfur. Journal of Organic Chemistry (1967), 32(12), pp. 3833-3836.
L. Bateman, C. G. Moore, Reactions of Sulfur with Olefin, Organic Sulfur Compounds, vol. 1, Chapter 20, pp. 210-211, Pergamon Press Ltd., Oxford London (1961).
Phillips 66, "Material Safety Data Sheet for TBP5454", Phillips 66 Material Safety Data Sheets (Apr. 28, 1996).
Rudnick, Leslie R., "Lubricant Additives", New York, Marcel Dekker, Inc. (2003).
TPS 32 (Di-Tertiary Dodecyl Polysulfide) Data Sheet (Oct. 2004).

* cited by examiner

*Primary Examiner* — Joseph D Anthony

(57) ABSTRACT

A gear oil additive composition and gear oil composition comprising a organic polysulfide having at least 30 wt % of a dialkyl polysulfide compound or mixture of dialkyl polysulfide compounds, a thiadiazole; and at least one ashless phosphorus-containing wear inhibitor compound is disclosed as having low yellow corrosion in axles and transmissions.

24 Claims, No Drawings

GEAR OIL HAVING LOW COPPER CORROSION PROPERTIES

PRIORITY

This application is a divisional of U.S. patent application Ser. No. 12/928,778, filed Dec. 17, 2010 now U.S. Pat. No. 8,389,449 which is a continuation of U.S. patent application Ser. No. 12/187,923, now U.S. Pat. No. 7,871,965, filed Aug. 7, 2008, which is a continuation of U.S. patent application Ser. No. 10/423,641, filed Apr. 25, 2003, now abandoned, the contents of which are incorporated herein by reference.

The present invention relates to a gear oil additive composition and a gear oil composition containing the same. In particular, the present invention relates to a gear oil additive composition used to reduce corrosion of yellow metal components which are present in axles and transmissions. Further, the present invention relates to a method of reducing yellow metal corrosion in axles and transmissions.

BACKGROUND OF THE INVENTION in gear oil applications, sulfurized olefins are typically used to protect gears from scoring. However, these sulfur compounds are extremely corrosive towards yellow metals, such as copper and copper alloys. The sulfur components in combination with phosphorus components produce a composition that degrades the copper. Gear oil specifications have minimum requirements for copper corrosion. For example, the API GL-5 category requires a maximum rating of 3 in the ASTM D-130 Test. However, this test does not provide a quantitative measurement of copper corrosion. It is a visual rating based on the discoloration of a copper strip. To obtain a quantitative measurement, we use the copper catalyst weight loss measurement from the ASTM D-5704 Test. The copper catalyst weight loss also reveals the copper corrosiveness of the oxidized oil.

Sulfurized isobutylenes are widely used in formulating gear lubricants intended for API GL-5 service. However, this type of sulfur-containing extreme pressure component causes large copper catalyst weight loss in the ASTM D-5704 test.

European Patent Application No. 678 569 B1 discloses a lubricating composition comprising a major amount of an oil of lubricating viscosity with an iodine number less than 4, (A) one or more ashless antioxidants selected from amine antioxidants, dithiophosphoric esters, phenol antioxidants, dithiocarbamates and aromatic phosphates, (B) from 0.01 to 3% by weight of at least one boron-containing dispersant or detergent, and optionally, (C) at least one additive selected from (i) a sulfur containing antiwear or extreme pressure agent, (ii) a phosphorus or boron antiwear or extreme pressure agent, and (iii) mixtures thereof, provided that (C) is different from (A), and wherein the total amount of antioxidant is from 2 to 10% by weight. The additives are useful for controlling oxidation of lubricants. Further, these lubricants have reduced viscosity increase caused by oxidation, while maintaining favorable carbon/varnish ratings.

U.S. Pat. No. 6,362,136 discloses compositions containing a sulfur-containing antiwear/extreme pressure agent, basic nitrogen compound or a mixture thereof together with a hydrocarbyl mercaptan. The composition may additionally contain a phosphorus or boron antiwear or extreme pressure agent, a dispersant or an overbased metal salt. This patent also relates to lubricants, functional fluids, and concentrates containing the same. Seals, e.g. nitrile, polyacrylate, and fluoroelastomer seals, in contact with these compositions have reduced deterioration. This patent teaches that with the use of these compositions, lubricants, and functional fluids, the seals useful life is extended.

U.S. Pat. No. 6,262,000 discloses that the antiwear performance of power transmitting fluids, particularly continuously variable transmission fluids, is improved by incorporating an additive combination of amine phosphates, organic polysulfides, zinc salts of phosphorothioic acid esters and optionally a friction modifier.

U.S. Pat. No. 5,254,272 discloses lubricant compositions especially useful as hydraulic fluids contain a metal-free antiwear or load-carrying additive containing sulfur and/or phosphorus and an amino succinate ester as corrosion inhibitor. This patent teaches that such compositions are free from heavy metal and have improved environmental acceptability where heavy metals are to be avoided, e.g. in agriculture.

U.S. Pat. No. 5,342,531 discloses a lubricant composition comprising a major proportion of polyalkylene glycol of lubricating viscosity and a minor proportion dissolved therein of (a) at least one sulfur-containing antiwear or extreme pressure agent, (b) at least one amine salt of at least one partially esterified monothiophosphoric acid, and (c) at least one amine salt of at least one partially esterified phosphoric acid. This patent teaches that such compositions have improved resistance to wear, oxidative degradation and metallic corrosion.

U.S. Pat. No. 5,942,470 discloses gear oils and gear oil additive concentrates of enhanced positraction performance comprising: (i) at least one oil-soluble sulfur-containing extreme pressure or antiwear agent; (ii) at least one oil-soluble amine salt of a partial ester of an acid of phosphorus; and (iii) at least one oil-soluble succinimide compound. These compositions preferably contain one, more preferably two, and most preferably all three of the following additional components: (iv) at least one amine salt of a carboxylic acid; (v) at least one nitrogen-containing ashless dispersant; and (vi) at least one trihydrocarbyl ester of a pentavalent acid of phosphorus.

Japanese Patent No. JP 2000-328084 discloses a gear oil composition comprising a specified dialkyltrisulfide, a specified dithiophosphoric ester, and one or more of acidic phosphoric and phosphorus esters and alkylamine salts of the esters in a base oil of a kinematic viscosity at 100° C. The composition has high oxidation stability and corrosion resistance to copper at temperatures of 150° C. or higher.

U.S. Pat. No. 4,609,480 discloses a lubricant composition effective in extending the fatigue life and increasing the corrosion resistance of the machine parts lubricated therewith. The lubricant composition comprises two types of essential additives, namely (a) a dithiocarbamic acid ester and/or an alkyl thiocarbamoyl compound and (b) a 1,3,4-thiadiazole compound admixed with the lubricant base material each in a limited amount. In addition to the above mentioned advantages, the resistance against scoring can further be increased by the admixture of the lubricant composition with a third additive (c) such as sulfurized olefins, sulfurized oils, sulfurized oxymolybdenum dithiocarbamates, sulfurized oxymolybdenum organophosphordithioates, phosphoric acid esters and phosphorus esters.

SUMMARY OF THE INVENTION

The present invention provides a gear oil additive composition having low corrosion of yellow metal components of axles and transmissions, particularly copper and copper alloys. The gear oil additive composition comprises:

a) an organic polysulfide containing greater than 30 wt % of a dialkyl polysulfide compound or mixture of dialkyl polysulfide compounds of the formula:

$$R_1—(S)_x—R_2$$

wherein $R_1$ and $R_2$ are independently an alkyl group of about 4 to 12 carbon atoms and x is about 4 or greater;

b) a thiadiazole; and c) at least one ashless phosphorus-containing wear inhibitor compound.

Preferably, the gear oil additive composition will contain about 40 to 75 wt % of the organic polysulfide, about 0.5 to 15 wt % of the thiadiazole and about 5.0 to 40 wt % of the ashless phosphorus-containing wear inhibitor compound.

In another aspect, the present invention also provides for a gear oil composition comprising a major amount of a base oil of lubricating viscosity and a minor amount of the gear oil additive composition of the present invention.

In still another aspect, the present invention also provides for a method of reducing the yellow metal corrosion of axles and transmission by contacting the metal components of the axle and transmission with the gear oil composition.

Among other factors, the present invention is based on the surprising discovery that a gear oil additive composition and gear oil composition having low odor and low chlorine significantly reduces corrosion of yellow metal components of axles and transmissions, particularly copper and copper alloys. The compositions of the present invention have an advantageously tower odor than comparable compositions currently available in the marketplace. Moreover, in view of the increasingly stringent requirements regarding the chlorine content of additives for petroleum products, the low levels of chlorine associated with the present invention is advantageous since any chlorine discharged into the environment accidentally or as waste is environmentally undesirable. Preferably, the additive compositions of the present invention will not contain compounds containing zinc. The compositions of the present invention can advantageously have a lower sulfur treat rate (organic polysulfide) than comparable compositions utilizing sulfurized isobutylene, while providing comparable or improved gear scoring resistance and improved performance in reducing yellow metal corrosion.

DETAILED DESCRIPTION OF THE INVENTION

The gear oil additive composition and gear oil position will now be described more thoroughly below.

Gear Oil Additive Composition

The present invention provides a gear oil additive composition comprising:

a) an organic polysulfide containing greater than 30 wt % of a dialkyl polysulfide compound or mixture of dialkyl polysulfide compounds of the formula:

$$R_1—(S)_x—R_2$$

wherein $R_1$ and $R_2$ are independently an alkyl group of about 4 to 12 carbon atoms and x is about 4 or greater;

b) a thiadiazole; and c) at least one ashless phosphorus-containing wear inhibitor compound.

Preferably, the gear oil additive composition will contain the organic polysulfide in the range from about 45 to 70 wt % and, more preferably from about 50 to 65 wt %.

Preferably, the organic polysulfide will contain at least 40 wt % and, more preferably at least 50 wt %, and most preferably at least 55 wt % of the dialkyl polysulfide compound or mixture of dialkyl polysulfide compounds.

Preferably, $R_1$ and $R_2$ are independently an alkyl group of about 4 to 10 carbon atoms and more preferably, about 4 to 6 carbon atoms. Most preferably, $R_1$ and $R_2$ are each a tertiary-butyl group.

Preferably, x is about 4 to 8 and more preferably, x is about 4 to 7.

Preferably, the organic polysulfide is predominantly a di-tertiary-butyl tetra-sulfide. More preferably, the organic polysulfide is a mixture of di-tertiary-butyl tri-, tetra- and penta-sulfide having greater than 50 wt % di-tertiary-butyl-tetra-sulfide such as the di-tertiary-butyl polysulfide known as TSPS 454, which is commercially available from Chevron Phillips Chemical Company.

The gear oil additive composition will also contain thiadiazole. Preferably, the thiadiazole comprises at least one of 2,5-dimercapto-1,3,4-thiadiazole; 2-mercapto-5-hydrocarbylthio-1,3,4-thiadiazoles; 2-mercapto-5-hydrocarbyldithio-1,3,4-thiadiazoles; 2,5-bis(hydrocarbylthio)- and 2,5-bis(hydrocarbyldithio)-1,3,4-thiadiazoles. The more preferred compounds are the 1,3,4-thiadiazoles, especially the 2-hydrocarbyldithio-5-mercapto-1,3,4-dithiadiazoles and the 2,5-bis(hydrocarbyldithio)-1,3,4-thiadiazoles, a number of which are available as articles of commerce from either Ethyl Corporation as Hitec® 4313 or from Lubrizol Corporation as Lubrizol5955A. Typically, the thiadiazole will be present in the gear oil additive composition in amounts ranging from about 0.5 to 15 wt %, and will preferably be present in the gear oil additive composition in amounts from about 0.7 to 12 wt % and more preferably from about 1.0 to 10 wt %.

The gear oil additive composition of the present invention will further contain at least one ashless phosphorus-containing wear inhibitor compound preferably selected from the group consisting of an amino phosphorus compound and a trialkyl phosphite.

The amino phosphorus compound may be a phosphorus compound as described in accordance with Salentine, U.S. Pat. No. 4,575,431, the disclosure of which is herein incorporated by reference. Preferably, the amino phosphorus compound is an amine dithiophosphate. Typical dithiophosphates useful in the lubricant of the present invention are well known in the art. These dithiophosphates are those containing two hydrocarbyl groups and one hydrogen functionality, and are therefore acidic. The hydrocarbyl groups useful herein are preferably aliphatic alkyl groups of about 3 to 8 carbon atoms.

Trialkyl phosphites useful in the present invention include $(RO)_3P$ where R is a hydrocarbyl of about 4 to 24 carbon atoms, more preferably about 8 to 18 carbon atoms, and most preferably about 10 to 14 carbon atoms. The hydrocarbyl may be saturated or unsaturated. Preferably, the trialkyl phosphite contains at least 75 wt % of the structure $(RO)_3P$ wherein R is as defined above. Representative trialkyl phosphites include, but are not limited to, tributyl phosphite, trihexyl phosphite, trioctyl phosphite, tridecyl phosphite, trilauryl phosphite and trioleyl phosphite. A particularly preferred trialkyl phosphite is trilauryl phosphite, such as commercially available Duraphos TLP by Rhoda Incorporated Phosphorus & Performance Derivatives. Preferred are mixtures of phosphites containing hydrocarbyl groups having about 10 to 14 carbon atoms. These mixtures are usually derived from animal or natural vegetable sources. Representative hydrocarbyl mixtures are commonly known as coco, tallow, tall oil, and soya.

Typically, the gear oil additive composition will contain about 5.0 to 40 wt % of the ashless phosphorus-containing wear inhibitor compound. Preferably, the ashless phosphorus-containing wear inhibitor compound will be present from about 7.0 to 35 wt % and more preferably from about 10 to 35 wt %.

The gear oil additive composition will optionally contain sufficient organic liquid diluent to make it easy to handle during shipping and storage. Typically, the gear oil additive composition will contain from about 0 to 20 wt % of the organic liquid diluent and preferably about 3 to 15 wt %.

Suitable organic diluents which can be used include, for example, solvent refined 100N, i.e., Cit-Con 100N, and hydrotreated 100N, i.e., Chevron 100N, and the like. The organic diluent preferably has a viscosity of from about 1.0 to 20 cSt at 100° C.

The gear oil additive composition may also further contain a dispersant compound in a range from about 3.0 to 45% it %.

The components of the gear oil additive composition can be blended in any order and can be blended as combinations of components. The gear oil additive composition produced by blending the above components might be a slightly different composition than the initial mixture because the components may interact.

If desired, an additional sulfur-containing compound or mixture of compounds, such as sulfurized olefins, for example, sulfurized isobutylene, sulfurized fatty esters, sulfurized oils, sulfurized fatty acids, and alkenyl monosulfides, may be added as an additional component of the gear oil additive composition or to lubricating oils containing the gear oil additive composition.

Gear Oil Composition

The organic polysulfide, thiadiazole, and ashless phosphorus-containing wear inhibitor are generally added to a base oil that is sufficient to lubricate gears which are present in axles and transmissions. Typically, the gear all composition will contain a major amount of a base oil of lubricating viscosity and a minor amount of the gear oil additive composition described above.

The base oil of lubricating viscosity used in such compositions may be mineral oils or synthetic oils of viscosity suitable for use in gears. The base oils may be derived from synthetic or natural sources. Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having desired viscosity. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful. Group I base oil is preferred.

In its broadest aspect, the oil composition of the present invention will comprise:

a) a major amount of a base oil of lubricating viscosity; and b) a minor amount of a gear oil additive composition comprising:

(i) a organic polysulfide containing greater than 30 wt % of a dialkyl polysulfide compound or mixture of dialkyl polysulfide compounds of the formula:

$$R_1—(S)_x—R_2$$

wherein $R_1$ and $R_2$ are independently an alkyl group of about 4 to 12 carbon atoms and x is about 4 or greater, (ii) a thiadiazole; and (iii) at least one ashless phosphorus-containing wear inhibitor.

Typically, the gear oil composition comprise about 0.1 to 3.6 wt %, preferably from about 0.6 to 2.5 wt % and more preferably from about 1.5 to 2.2 wt % of the organic polysulfide. The gear oil composition will also comprise about 0.01 to 0.6 wt % preferably from about 0.05 to 0.4 wt % and more preferably from about 0.1 to 0.3 wt % of the thiadiazole. The gear oil composition will further comprise about 0.1 to 2.5 wt %, preferably from about 0.2 to 1.7 wt % and more preferably from about 0.4 to 1.2 wt % of the ashless phosphorus-containing wear inhibitor compound.

The gear oil composition may also further contain a dispersant compound in the range from about 0.1 to 2.7 wt %.

In another aspect the gear oil composition of the present invention will have chlorine levels typically below 50 ppm and more preferably below 25 ppm.

Other Additives

The following additive components are examples of some of the components that can be favorably employed in the present invention. These examples of additives are provided to illustrate the present invention, but they are not intended to limit it:

1. Metal Detergents

Sulfurized or unsulfurized alkyl or alkenyl phenates, alkyl or alkenyl aromatic sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, borated overbased metal salts, and chemical and physical mixtures thereof.

2. Dispersants

Alkenyl succinimides, alkenyl succinimides modified with other organic compounds, alkenyl succinimides modified by post-treatment with ethylene carbonate or boric acid, pentaerythritol alkenyl succinates, phenate-salicylates and their post-treated analogs, alkali metal or mixed alkali metal, alkaline earth metal borates, dispersions of hydrated alkali metal borates, dispersions of alkaline-earth metal berates, polyamide ashless dispersants, or mixtures of such dispersants.

3. Anti-Oxidants

Anti-oxidants reduce the tendency of mineral oils to deteriorate in service which deterioration is evidenced by the products of oxidation such as sludge and varnish-like deposits on the metal surfaces and by an increase in viscosity. Examples of anti-oxidants useful in the present invention include, but are not limited to, phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-1-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tart-butyl-4-hydroxybenzyl). Diphenylamine-type oxidation inhibitors include, but are not limited to, alkylated diphenylamine, phenyl-α-naphthylamine, and alkylated-α-naphthylamine. Other types of oxidation inhibitors include metal dithiocarbamate (e.g., zinc dithiocarbamate), and methylenebis(dibutyldithiocarbamate).

4. Anti-Wear Agents

As their name implies, these agents reduce wear of moving metallic parts. Examples of such agents include, but are not limited to, phosphates, carbonates, esters, and molybdenum complexes.

5. Rust Inhibitors (Anti-Rust Agents)

a) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate.

b) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

6. Demulsifiers

Addition product of alkylphenol and ethylene oxide, polyoxyethylene alkyl ether, and polyoxyethylene sorbitan ester.

7. Extreme Pressure Anti-Wear Agents (EP/AW Agents)

Diphenyl sulfide, methyl trichlorostearate, chlorinated naphthalene, fluoroalkylpolysiloxane, lead naphthenate, neutralized phosphates, neutralized or partially neutralized thiophosphates or dithiophosphates, and sulfur-free phosphates.

8. Friction Modifiers

Fatty alcohol, fatty acid, amine, borated ester, and other esters, and di-hydrocarbyl hydrogen phosphonates.

9. Multifunctional Additives

Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

10. Viscosity Index Improvers

Polymethacrylate type polymers, ethylene-propylene copolymers, styrene-isoprene copolymers, hydrated styrene-isoprene copolymers, polyisobutylene, and dispersant type viscosity index improvers.

11. Pour Point Depressants

Polymethyl methacrylate.

12. Foam Inhibitors

Alkyl methacrylate polymers and dimethyl silicone polymers.

13. Metal Deactivators

Disalicylidene propylenediamine, triazole derivatives, mercaptobenzothiazoles, and mercaptobenzimidazoles.

EXAMPLES

The invention will be further illustrated by the following examples, which set forth particularly advantageous method embodiments. While the Examples are provided to illustrate the present invention, they are not intended to limit it. This application is intended to cover those various changes and substitutions that may be made by those skilled in the art without departing from the spirit and scope of the appended claims.

Comparative Example A 2.4 wt % (194.0 grams) of an organic polysulfide containing a mixture of di-tertiary-butyl tri-, tetra-, and penta-sulfide having greater than 50 wt % di-tertiary-butyl tetra-sulfide (available as TBPS 454 from Chevron Phillips Chemical Company), 12.4 wt % (990.0 grams) of solvent refined bright stock base oil (Citgo 150), and 85.2 wt % (6,817.0 grams) of hydro-processed 600 neutral base oil (Chevron 600N) were mixed until the mixture was homogenous.

Comparative Example B 2.4 wt % (247.0 grams) of an organic polysulfide containing a mixture of di-tertiary-butyl tri-, tetra-, and Penta-sulfide having greater than 50 wt % di-tertiary-butyl tetra-sulfide (available as TBPS 454 from Chevron Phillips Chemical Company), 1.1 wt % (110.0 grams) of amine dithiophosphate (as described in Salentine, U.S. Pat. No. 4,575,431), 12.2 wt % (1,248.0 grams) of Citgo 150 bright stock (base oil), and 84.3 wt % (8,595.0 grams) of hydro-processed 600 neutral base oil (Chevron 600N) were mixed until the mixture was homogenous.

Comparative Example C 2.4 wt % (12.1 grams) of an organic polysulfide containing a mixture of di-tertiary-butyl tri-, tetra-, and penta-sulfide having greater than 50 wt % di-tertiary-butyl tetra-sulfide (available as TBPS 454 from Chevron Phillips Chemical Company), 0.3 wt % (1.5 grams) of thiadiazole (available as Hitec 4313 from Ethyl Corporation), 12.3 wt % (61.7 grams) of solvent refined bright stock base oil (Citgo 150), and 85.0 wt (424.7 grams) of hydro-processed 600 neutral base oil (Chevron 600N) were mixed until the mixture was homogenous.

Comparative Example D 4.0 wt % (320.0 grams) of sulfurized isobutylene having 47 wt % sulfur (available as Mobilad C-100 from ExxonMobil Chemical Company), 12.2 wt % (974.0 grams) of solvent refined bright stock base oil (Citgo 150), and 83.8 wt % (6,706.0 grams) of hydro-processed 600 neutral base oil (Chevron 600N) were mixed until the mixture was homogenous.

Comparative Example E 3.6 wt % (18.0 grams) of sulfurized isobutylene having 47 wt % sulfur (available as Mobilad C-100 from ExxonMobil Chemical Company), 1.1 wt % (5.4 grams) of amine dithiophosphate (as described in Salentine, U.S. Pat. No. 4,575,431), 12.1 wt % (60.4 grams) of solvent refined bright stock base oil (Citgo 150), and 83.2 wt % (416.2 grams) of hydra-processed 600 neutral base oil (Chevron 600N) were mixed until the mixture was homogenous.

Comparative Example F 3.6 wt % (18.0 grams) of sulfurized isobutylene having 47 wt % sulfur (available as Mobilad C-100 from ExxonMobil Chemical Company), 0.3 wt % (1.5 grams) of thiadiazole (available as Hitec® 4313 from Ethyl Corporation), 12.2 wt % (60.9 grams) of solvent refined bright stock base oil (Citgo 150), and 83.9 wt % (419.6 grams) of hydro-processed 600 neutral base oil (Chevron 600N) were mixed until the mixture was homogenous.

Comparative Example G

Base Additive Package K

Base additive package K was prepared as follows: 69.2 wt % (346.1 grams) of sulfurized isobutylene having 47 wt % sulfur (available as Mobilad C-100 from ExxonMobil Chemical Company), 20.2 wt % (101.0 grams) of amine dithiophosphate (as described in Salentine, U.S. Pat. No. 4,575,431), 5.8 wt % (28.9 grams) of thiadiazole (available as Hitec® 4313 from Ethyl Corporation), and 4.81 wt % (24.0 grams) of solvent refined 100 neutral base oil (Exxon 100N) were mixed until the mixture was homogenous.

Comparative Example H 5.2 wt % (26.0 grams) of the base package K, 12.5 wt % (62.7 grams) of solvent refined bright stock base oil (Citgo 150), and 82.3 wt % (411.3 grams) of solvent refined 600 neutral base oil (Exxon 600N) were mixed until the mixture was homogenous.

Comparative Example I 5.2 wt % (26.0 grams) of the base package K, 1.2 wt % (6.2 grams) of 1300 molecular weight succinimide ethylene carbonate post-treated dispersant, 15.0 wt % (75.0 grams) of solvent refined bright stock base oil (Citgo 150), and 78.6 wt % (392.8 grams) of solvent refined 600 neutral base oil (Exxon 600N) were mixed until the mixture was homogenous.

Comparative Example J 5.2 wt % (26.0 grams) of the base package K, 1.2 wt % (6.2 grams) of 2300 molecular weight succinimide ethylene carbonate post-treated dispersant, 15.0 wt % (75.0 grams) of solvent refined bright stock base oil (Citgo 150), and 78.6 wt % (392.8 grams) of solvent refined 600 neutral base oil (Exxon 600N) were mixed until the mixture was homogenous.

Comparative Example K 5.2 wt % (26.0 grams) of the base package K, 1.2 wt % (6.2 grams) of 1000 molecular weight succinimide dispersant, 15.0 wt % (75.0 grams) of solvent refined bright stock base oil (Citgo 150), and 78.6 wt (392.8 grams) of solvent refined 600 neutral base oil (Exxon 600N) were mixed until the mixture was homogenous.

Comparative Example L 5.2 wt % (26.0 grams) of the base package K, 1.2 wt % (6.2 grams) of pentaerythritol and polyisobutenyl succinic anhydride (molecular weight 1000) ester dispersant, 15.0 wt % (75.0 grams) of solvent refined bright stock base oil (Citgo 150), and 78.6 wt % (392.8 grams) of solvent refined 600 neutral base oil (Exxon 600N) were mixed until the mixture was homogenous.

Comparative Example M

A gear oil additive composition was prepared as follows: 67.9 wt % (679.3 grams) of sulfurized, isobutylene having 47 wt % sulfur (available as Mobilad C-100 from ExxonMobil Chemical Company), 9.4 wt % (94.3 grams) of amine dithiophosphate (as described in Salentine, U.S. Pat. No. 4,575,431), 12.3 wt % (122.6 grams) of trilauryl phosphate (available as Duraphos TLP from Rhodia Inc. Phosphorus & Performance Derivatives), 5.7 wt % (56.6 grams) of thiadiazole (available as Lubrizol® 5955A from Lubrizol Corporation), and 4.7 wt % (47.2 grams) of solvent refined 100 neutral base oil (Exxon 100N) were mixed until the mixture was homogenous.

5.3 wt % (901.0 grams) of the additive package above described, 18.9 wt % (3,220.0 grams) of solvent refined bright stock base oil (Citgo 150), and 75.8 wt % (12,879.0 grams) of solvent refined 600 neutral base oil (Exxon 600N) were mixed until the mixture was homogenous.

Comparative Example N 3.0 wt % (108.0 grams) of a di-t-butyl polysulfide containing at least 80 wt % of di-t-butyl tri-sulfide (available as TBPS 344 from Chevron Phillips Chemical Company, 12.3 wt % (442.8 grams) of solvent refined bright stock base oil (Citgo 150), and 84.7 wt % (3,049.2 grams) of solvent refined 600 neutral base oil (Exxon 600N) were mixed until the mixture was homogenous.

Comparative Example O

L42 Test Evaluation

As mentioned in the background of this application, sulfur containing compounds are typically used in gear oil formulations to protect the gears from scoring. The API GL-5 category specifies the L42 test method as the procedure for determining the load carrying capacity of the lubricant under conditions of high-speed and shock loads.

The L42 test procedure is described in ASTM Technical Publication STP512A "Laboratory Performance Test for Automotive Gear Lubricants Intended for API GL-5 Service" available from ASTM International at 100 Barr Harbor Drive, PO Box C700, West Conshohocken, Pa. 19428-2959 and is incorporated herein for all purposes.

Comparative Example A (having an organic polysulfide containing a mixture of di-tertiary-butyl tri-, tetra-, and penta-sulfide, and having greater than 50 wt % of a di-tertiary-butyl tetra-sulfide) and Comparative Example N (having an organic polysulfide containing a di-t-butyl polysulfide containing at least 80 wt % of di-t-butyl tri-sulfide) were evaluated in the L42 test.

Comparative Example A passed the L42 test and Example N failed the L42 test.

Example 1

A gear oil additive composition was prepared as follows: 63.7 wt % (318.4 grams) of an organic polysulfide containing a mixture of di-tertiary-butyl tri-, tetra-, and penta-sulfide and having greater than 50 wt % di-tertiary-butyl tetra-sulfide (available as TBPS 454 from Chevron Phillips Chemical Company), 28.4 wt % (142.1 grams) of amine dithiophosphate (as described in Salentine, U.S. Pat. No. 4,575,431), 7.9 wt % (39.5 grams) of thiadiazole (available as Hitec® 4313 from Ethyl Corporation), were mixed until the mixture was homogenous.

3.8 wt % (456.0 grams) of the gear oil additive composition described above, 12.2 wt % (1,464.0 grams) of solvent refined bright stock base oil (Citgo 150), and 84.0 wt % (10,080.0 grams) of hydro-processed 600 neutral base oil (Chevron 600N) were mixed at 130° F. until the mixture was homogenous.

A gear oil additive composition was prepared as follows: 52.9 wt % (264.7 grams) of an organic polysulfide containing a mixture of di-tertiary-butyl tri-, tetra-, and penta-sulfide and having greater than 50 wt % di-tertiary-butyl tetra-sulfide (available as TBPS 454 from Chevron Phillips Chemical Company), 30.9 wt % (154.4 grams) of amine dithiophosphate (as described in Salentine, U.S. Pat. No. 4,575,431), 8.8 wt % (44.1 grams) of thiadiazole (available as Hitec® 4313 from Ethyl Corporation), and 7.4 wt % (36.8 grams) of solvent refined 100 neutral base oil (Exxon 100N) were mixed until the mixture was homogenous.

3.4 wt % (255.0 grams) of the gear oil additive composition described above, 15.0 wt % (1,125.0 grams) of solvent refined bright stock base oil (Citgo 150), and 81.6 wt % (6,120.0 grams) of solvent refined 600 neutral base oil (Exxon 600N) were mixed until the mixture was homogenous.

Example 3

Base Additive Package J

Base additive package J was prepared as follows: 52.9 wt % (529.4 grams) of an organic polysulfide containing a mixture of di-tertiary-butyl tri-, tetra-, and penta-sulfide and having greater than 50 wt % di-tertiary-butyl tetra-sulfide (available as TBPS 454 from Chevron Phillips Chemical Company), 30.9 wt % (308.8 grams) of amine dithiophosphate (as described in Salentine, U.S. Pat. No. 4,575,431), 8.8 wt % (88.2 grams) of thiadiazole (available as Hitec® 4313 from Ethyl Corporation), and 7.4 wt % (73.6 grams) of solvent refined 100 neutral base oil (Exxon 100N) were mixed until the mixture was homogenous.

Example 4

3.4 wt % (17.0 grams) of the base package J, 1.2 wt % (6.2 grams) of 1300 molecular weight succinimide ethylene carbonate post-treated dispersant, 15.0 wt % (75.0 grams) of solvent refined bright stock base oil (Citgo 150), and 80.4 wt % (401.8 grams) of solvent refined 600 neutral base oil (Exxon 600N) were mixed until the mixture was homogenous.

Example 5

3.4 wt (17.0 grams) of the base package J, 1.2 wt (6.2 grams) of pentaerythritol and polyisobutenyl succinic anhydride (molecular weight 1000) ester dispersant, 15.0 wt % (75.0 grams) of solvent refined bright stock base oil (Citgo 150), and 80.4 wt % (401.8 grams) of solvent refined 600 neutral base oil (Exxon 600N) were mixed until the mixture was homogenous.

Example 6

3.4 wt % (17.0 grams) of the base package J, 1.2 wt % (6.2 grams) of a highly over-based mixture of phenate and salicylate, 15.0 wt % (75.0 grams) of solvent refined bright stock base oil (Citgo 150), and 80.4 wt % (401.8 grams) of solvent refined 600 neutral base oil (Exxon 600N) were mixed until the mixture was homogenous.

Example 7

3.4 wt % (17.0 grams) of the base package J, 2.5 wt % (12.5 grams) of a polyisobutenyl succinic anhydride (molecular weight 2300), 14.8 wt % (74.0 grams) of solvent refined bright stock base oil (Citgo 150), and 79.3 wt % (396.5 grams) of solvent refined 600 neutral base oil (Exxon 600N) were mixed until the mixture was homogenous.

Example 8

3.4 wt % (17.0 grams) of the base package J, 1.2 wt % (6.2 grams) of 2300 molecular weight succinimide ethylene carbonate post-treated dispersant, 15.0 wt % (75.0 grams) of solvent refined bright stock base oil (Citgo 150), and 80.4 wt % (401.8 grams) of solvent refined 600 neutral base oil (Exxon 600N) were mixed until the mixture was homogenous.

Example 9

3.4 wt % (17.0 grams) of the base package J, 1.2 wt % (6.2 grams) of 1000 molecular weight succinimide dispersant, 15.0 wt % (75.0 grams) of solvent refined bright stock base oil (Citgo 150), and 80.4 wt % (401.8 grams) of solvent refined 600 neutral base oil (Exxon 600N) were mixed until the mixture was homogenous.

Example 10

A gear oil additive composition was prepared as follows: 51.4 wt % (514.3 grams) of an organic polysulfide containing a mixture of di-tertiary-butyl tri-, tetra-, and penta-sulfide and having greater than 50 wt % di-tertiary-butyl tetra-sulfide (available as TBPS 454 from Chevron Phillips Chemical Company), 14.3 wt % (142.9 grams) of amine dithiophosphate (as described in Salentine, U.S. Pat. No. 4,575,431), 18.6 wt % (185.7 grams) of trilauryl phosphite (available as Duraphos TLP from Rhodia inc. Phosphorus & Performance Derivatives), 8.57 wt % (85.7 grams) of thiadiazole (available as Lubrizol® 5955A from Lubrizol Corporation) and 7.1 wt % (71.4 grams) of solvent refined 100 neutral base oil (Exxon 100N) were mixed until the mixture was homogenous.

3.5 wt % (630.0 grams) of the gear oil additive composition described above, 19.3 wt % (3,474.0 grams) of solvent refined bright stock base oil (Citgo 150), and 77.2 wt % (13,896.0 grams) of solvent refined 100 neutral base oil (Exxon 100N) were mixed until the mixture was homogenous.

Example 11

3.4 wt % (17.0 grams) of the base package J, 0.5 wt % (2.5 grams) of a dispersed hydrated alkali metal borate (available as OLOA 9750 from Chevron Oronite Company), 15.1 wt % (75.6 grams) of solvent refined bright stock base oil (Citgo 150), and 81.0 wt % (404.9 grams) of solvent refined 600 neutral base oil (Exxon 600N) were mixed until the mixture was homogenous.

Example 12

3.4 wt % (17.0 grams) of the base package J, 2.5 wt % (12.5 grains) of a polyamide ashless dispersant (available as OLOA 340D from Chevron Oronite Company), 14.8 wt % (74.0 grams) of solvent refined bright stock base oil (Citgo 150), and 79.3 wt % (396.5 grams) of solvent refined 600 neutral base oil (Exxon 600N) were mixed until the mixture was homogenous.

Example 13

Performance Evaluation

Comparative Examples A-M and Examples 1-12 were evaluated following the ASTM D-5704 test procedure. In this test, a sample of the lubricant was placed in a heated gear case containing two spur gears, a test bearing, and a copper catalyst. The lubricant was heated to 325° F. and the gears were operated for 50 hours at predetermined load and speed conditions. Air was bubbled through the lubricant at a specified rate and the bulk oil temperature of the lubricant was controlled throughout the test. Parameters used for evaluating oil degradation after testing were viscosity increase, insolubles in the used oil, and gear cleanliness. Also, as part of the test report, the copper catalyst percent weight loss based upon the original weight of the copper strip was reported. The copper weight loss result indicates the copper activity of the test lubricants.

A copy of this test method can be obtained from ASTM International at 100 Barr Harbor Drive, PO Box 0700, West Conshohocken, Pa. 19428-2959 and is herein incorporated for all purposes.

The performance results are presented in Table 1.

TABLE 1

| | ASTM D-5704 Copper Catalyst Weight Loss (%) |
|---|---|
| Comparative Example A | 17.4 |
| Comparative Example B | 16.8 |
| Comparative Example C | 19.2 |
| Comparative Example D | 16.8 |
| Comparative Example E | 15.4 |
| Comparative Example F | 16.6 |
| Comparative Example H | 13.2 |
| Comparative Example I | 13.3 |
| Comparative Example J | 14.3 |
| Comparative Example K | 13.7 |
| Comparative Example L | 13.9 |
| Comparative Example M | 14.0 |
| Example 1 | 11.0 |
| Example 2 | 8.8 |
| Example 4 | 6.0 |
| Example 5 | 5.5 |
| Example 6 | 6.0 |

TABLE 1-continued

| | ASTM D-5704 Copper Catalyst Weight Loss (%) |
|---|---|
| Example 7 | 6.0 |
| Example 8 | 5.3 |
| Example 9 | 6.5 |
| Example 10 | 5.9 |
| Example 11 | 4.5 |
| Example 12 | 4.7 |

The results presented in Table 1 demonstrate that the compositions of the present invention (Examples 1-12) provide low copper corrosion as evidenced by the significantly lower percent copper weight loss when compared to the Comparative Examples A-M.

What is claimed is:

1. A method of reducing yellow metal corrosion in axles and transmissions, said method comprising contacting the metal components of the axle and transmission with a gear oil composition comprising:

c) a major amount of a base oil of lubricating viscosity; and (d) a minor amount of a gear oil additive composition comprising:

(i) an organic polysulfide containing greater than 50 wt % of a dialkyl polysulfide compound or mixture of dialkyl polysulfide compounds of the formula:

$$R_1—(S)_x—R_2$$

wherein $R_1$ and $R_2$ are independently an alkyl group alkyl of about 4 to 12 carbon atoms and x is 4 or greater;

(ii) a thiadiazole; and (iii) at least one ashless phosphorus-containing wear inhibitor compound; wherein component (i) is present at about 0.1 to 3.6 wt. %, wherein component (ii) is present at about 0.01 to 0.6 wt. %, and component (iii) is present at about 0.1 to 2.5 wt. %, all weight percentages base on the total weight of the gear oil composition.

2. The method according to claim 1, wherein the gear oil composition further comprises a dispersant additive selected from the group consisting of alkenyl succinimides, alkenyl succinimides modified by post-treatment with ethylene carbonate or boric acid, pentaerythritol alkenyl succinates, phenate-salicylates and their post-treated analogs, alkali metal or mixed alkali metal, alkaline earth metal borates, dispersion of hydrated alkali metal borates, dispersion of alkaline-earth metal borates, polyamide ashless dispersants, and mixtures thereof.

3. The method according to claim 2, wherein, the dispersant additive is present in the gear oil composition in a range from about 0.1 to 2.7 wt %.

4. The method according to claim 1, wherein the organic polysulfide is present in the gear oil composition from about 0.6 to 2.5 wt %.

5. The method according to claim 1, wherein the organic polysulfide is present in the gear oil composition from about 1.5 to 2.2 wt %.

6. The method according to claim 1, wherein the organic polysulfide contains at least 55 wt % of the dialkyl polysulfide compound or mixture of dialkyl polysulfide compounds.

7. The method according to claim 1, wherein $R_1$ and $R_2$ are independently an alkyl group about 4 to 10 carbon atoms.

8. The method according to claim 1, wherein $R_1$ and $R_2$ are independently an alkyl group of about 4 to 6 carbon atoms.

9. The method according to claim 1, wherein $R_1$ and $R_2$ are each a tertiary-butyl group.

10. The method according to claim 1, wherein x is 4 to 8.

11. The method according to claim 1, wherein x is 4 to 7.

12. The method according to claim 1, wherein the organic polysulfide is a di-tertiary-butyl polysulfide.

13. The method according to claim 1, wherein the organic polysulfide is a mixture of di-tertiary-butyl tri-, tetra-, and penta-sulfide.

14. The method according to claim 1, wherein the thiadiazole is present in the gear oil composition from about 0.05 to 0.4 wt %.

15. The method according to claim 1, wherein the thiadiazole is present in the gear oil composition from about 0.1 to 0.3 wt %.

16. The method according to claim 1, wherein the thiadiazole comprises at least one of 2,5-dimercapto-1,3,4-thiadiazole; 2-mercapto-5-hydrocarbylthio-1,3,4-thiadiazoles; 2-mercapto-5-hydrocarbyldithio-1,3,4-thiadiazoles 2,5-bis (hydrocarbyl or 2,5-bis(hydrocarbyldithio)-1,3,4-thiadiazoles.

17. The method according to claim 1, wherein the ashless phosphorus-containing wear inhibitor compound is present in the gear oil composition from about 0.2 to 1.7 wt %.

18. The method according to claim 1, wherein the ashless phosphorus-containing wear inhibitor compound is present in the gear oil composition from about 0.5 to 1.2 wt %.

19. The method according to claim 1, wherein the ashless phosphorus-containing wear inhibitor compound is at least one compound selected from the group consisting of an amino phosphorus compound and a trialkyl phosphite.

20. The method according to claim 19, wherein the amino phosphorus compound is an amine dithiophosphate.

21. The method according to claim 19, wherein the trialkyl phosphite is trilauryl phosphite.

22. The method according to claim 19, wherein the trialkyl phosphite contains at least 75 wt % of a trialkyl phosphate of the structure $(RO)_3P$, wherein R is a hydrocarbyl of about 4 to 24 carbon atoms.

23. The method according to claim 1, wherein the gear oil composition has a chlorine level below 50 ppm.

24. The method according to claim 1, wherein the gear oil additive composition comprises from about 35 to 75 wt of the organic polysulfide, about 0.5 to 15 wt. % of the thiadiazole, and about 5.0 to 40 wt % of the ashless phosphorus-containing wear inhibitor compound.

* * * * *